US005805127A

United States Patent [19]

Sonnek

[11] Patent Number: 5,805,127

[45] Date of Patent: Sep. 8, 1998

[54] MICROCONTROLLER INTERFACING WITH AN LCD

[75] Inventor: Martin Sonnek, St. Veit/Glan, Austria

[73] Assignee: U.S. Philips Corporation, New York, N.Y.

[21] Appl. No.: 554,121

[22] Filed: Nov. 6, 1995

[30] Foreign Application Priority Data

Nov. 28, 1994 [EP] European Pat. Off. ..... 94203446

[51] Int. Cl.[6] ..... G09G 3/00

[52] U.S. Cl. ..... 345/95; 345/210; 345/94

[58] Field of Search ..... 345/53, 94, 95, 345/208, 210; 349/1

[56] References Cited

U.S. PATENT DOCUMENTS

| | | | |
|---|---|---|---|
| 3,936,676 | 2/1976 | Fujita | 326/87 |
| 4,050,064 | 9/1977 | Hashimoto et al. | 345/210 X |
| 4,769,639 | 9/1988 | Kawamura et al. | 345/95 |
| 4,870,398 | 9/1989 | Bos | 345/210 X |
| 5,101,116 | 3/1992 | Morokawa | 345/95 X |
| 5,111,319 | 5/1992 | Morris | 345/95 |
| 5,301,047 | 4/1994 | Hoshino et al. | 345/95 X |
| 5,343,217 | 8/1994 | Kim | 345/95 |
| 5,510,814 | 4/1996 | Ise | 345/95 X |

FOREIGN PATENT DOCUMENTS

| | | | |
|---|---|---|---|
| 3427986A1 | 1/1986 | Germany | G09G 3/18 |

OTHER PUBLICATIONS

"Flat Panel Display Technology", by J. Ziegler et al, The Electrochemical Society Interface, Summer, 1994, pp. 27–32.

*Primary Examiner*—Mark R. Powell
*Assistant Examiner*—Seth D. Vail

[57] ABSTRACT

A microcontroller with three-state outputs is coupled to a small LCD via an interface with resistive voltage dividers. The controller has a separate control output to control adapting means for selectively modifying the voltage division, thus rendering a general-type microcontroller suitable for driving an LCD in, e.g., a ⅓ bias triplex mode using conventional low-cost hardware.

6 Claims, 2 Drawing Sheets

MICROCONTROLLER INTERFACING WITH AN LCD

BACKGROUND OF THE INVENTION

The invention relates to an apparatus comprising a liquid-crystal display (LCD). The LCD has input means to receive a control voltage for control of an optical state of the LCD, and control means coupled to the input means for providing the control voltage. The control means includes a controller having output means operative to selectively assume a logic high state, a logic low state or a high-impedance state, and an interface means between the input means and the output means. The interface means comprises voltage divider means to generate the control voltage. The invention also relates to such a control means and to an interface means for use in such an apparatus.

The invention relates in particular to an apparatus with a small LCD, i.e., whose LCD has a small number of independently controllable pixels or segments, e.g., in the order of 10–100. Typically, the small LCD then serves as an indicator or a gauge to provide visual information about an operational status of the apparatus.

An LCD comprises a particular substance whose optical characteristics are controllable by virtue of a voltages across the substance. The voltages are guided by means of an array of electrodes to create a multiple-segment or multiple-pixel display. The terms "pixel" and "segment" are used interchangeably in this text.

In practice, driving the pixels through individual leads and individual drivers is feasible only for displays with a modest number of pixels. When the number of pixels becomes inconveniently large a so-called matrix drive is employed in order to reduce the number of interconnections and drivers. In the matrix drive approach, the pixels are created at the intersections of a plurality of row and column electrodes, also referred to as select lines and data lines. The combined control of row and column electrodes governs the optical properties of selected ones of the pixels. There are two major strategies to control the matrix: static drive and dynamic drive.

Static drive applies various steady voltages to the electrodes. The principal limitation of static drive is the inability to display all possible patterns in a fixed array of pixels as it must satisfy selection requirements of all parts of the display simultaneously. For instance, a static scheme cannot display a closed figure with a hollow center in a rectangular array of pixels.

The dynamic addressing scheme, also referred to as multiplex drive, satisfies the conflicting drive requirements of different locations sequentially. The column electrodes then are scanned in sequence, only one being selected at any instant. If there are a plurality of N column electrodes for being scanned sequentially, the multiplex mode is referred to as being of the type 1/N. The information to be displayed is multiplexed onto the row electrodes which are shared by all columns in synchronism with the column scan. The multiplex drive of an LCD requires a plurality of drive signal levels in order to create relative differences between signal levels for discrimination between selected and unselected pixels. Multiplex drive in, for example, an LCD, is established by applying to the row electrodes voltages representative of the data to become manifest in a given column during the selection interval for that column. The instantaneous potential difference across an excited pixel is made larger than the voltage across an unexcited pixel.

German Patent Application Publication DE 34 27 986 illustrates an apparatus wherein a controller drives an LCD in a multiplex drive mode. The data signals driving the LCD can have three different voltage levels during a drive cycle. Outputs of the controller are coupled to the row and column electrodes of the LCD via respective voltage dividers in order to supply the required voltage levels. The output drivers of the controller can be of the open-drain type, so that a common pull-up resistor is permanently connected to the controller's outputs in parallel. Alternatively, the controller can be provided with tri-state output drivers so that the pull-up resistor is dispensed with.

In the tri-state version of the prior art apparatus, a respective output of the controller interfaces with a respective input of the LCD via a respective series arrangement of a series resistor and a respective voltage divider. The divider has an upper resistor and a lower resistor connected in series between the supply voltages. Accordingly, the series resistor is either connected in parallel to the upper resistor, or to the lower resistor, or is connected to a high-ohmic terminal, dependent on the state of the output driver. The known apparatus therefore is suitable for driving the LCD with only three voltage levels at the LCD's input. For example, a triplex drive mode using voltage levels of, e.g., GND, Vcc, ⅓Vcc and ⅔Vcc, is not possible.

SUMMARY OF THE INVENTION

It is an object of the invention to provide an apparatus as specified in the preamble, that renders feasible a wider range of multiplex modes than the prior art such as a triplex mode. It is also an object to provide such an apparatus using a conventional controller and simple interface means. It is a further object to provide a low-cost control means for a small LCD.

To this end, the apparatus according to the invention is characterized in that the controller has at least one further output means and in that the interface means comprises adaption means coupled between the further output means and the voltage divider means for selectively adapting a voltage division operation of the voltage divider means.

The invention is based on the insight that connecting the adaption means between the further output of the controller and the voltage division means provides additional degrees of freedom to generate a larger multitude of voltage levels than were attainable in the prior art. Note that in the prior art only three levels can be generated owing to the fixed arrangement of the series resistor, that either is connected in parallel to one of the divider's resistors, or is connected to a high-ohmic node. Basically, the invention provides simple circuitry that, in combination with appropriate software in the controller, has the advantage to perform at low cost the function of much more expensive dedicated display-driver ICs or of expensive microcontrollers with onboard display drivers.

The adaption means may comprise resistive means for being selectively coupled to the voltage divider means. The voltage division then is modified by controllably coupling additional resistors to a voltage divider. Alternatively or subsidiarily, the adaption means may comprise controllable current source means for being selectively coupled to the voltage divider means. Coupling the current source to a voltage divider, directly or indirectly, e.g., through additional resistors, causes an additional current to flow through at least a part of the voltage divider, thus modifying the voltage division operation.

Preferably, the voltage divider means comprises first and second voltage dividers, and the adaption means comprises resistive means for being selectively coupled to the first voltage divider, and controllable current source means for being selectively coupled to the second voltage divider. An output node of the controller may be used to control in parallel the coupling of the resistive means and the current source means to respective one of the voltage dividers. Alternatively, a plurality of output nodes may be used to implement a still more variable control scheme.

The invention enables selective modification of the control voltage provided by the voltage divider means in a simple manner using commercially available hardware of a common type. This substantially reduces manufacturing costs. The invention specifically renders feasible a ⅓ bias triplex drive mode for an LCD, e.g., for use in a consumer apparatus such as a household appliance.

BRIEF DESCRIPTION OF THE DRAWINGS

The invention is explained in more detail and by way of example with reference to the accompanying drawing wherein.

DETAILED DESCRIPTION OF THE PREFERRED EMBODIMENTS

Figure 1:
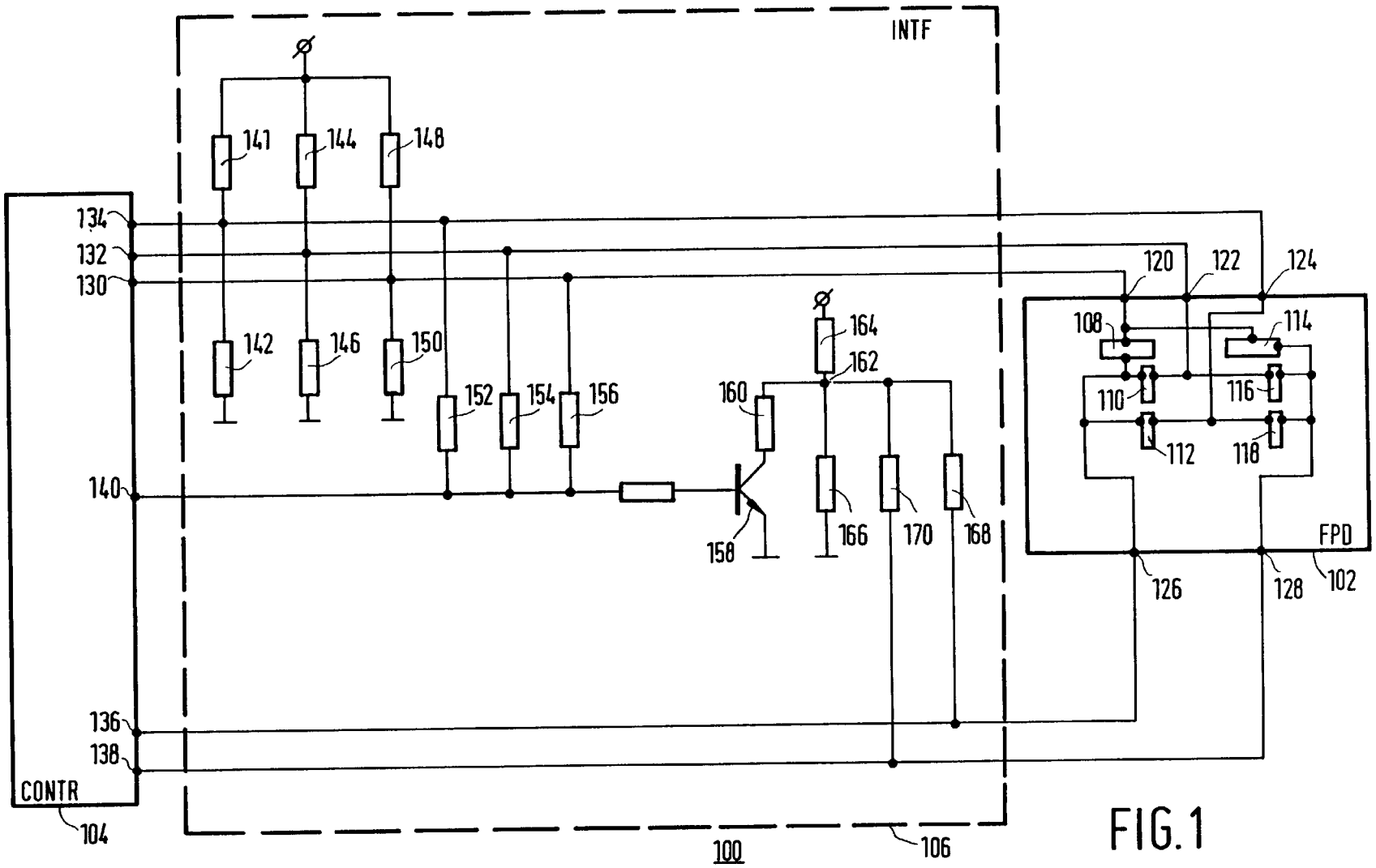
FIG. 1 is a diagram of an apparatus according to the invention.

FIG. 1 gives a block diagram of an apparatus 100 in accordance with the invention. Apparatus 100 comprises a small LCD 102, and a controller 104 to control LCD 102 in a multiplex mode via an interfacing circuit 106. LCD 102 comprises segments 108, 110, 112, 114, 116 and 118 whose optical state is governed via terminals 120, 122, 124, 126 and 128. Segments 108–112 form a first group that is selected as a first displayable item via terminal 126. Segments 114–118 form a second group that is selected as a second displayable item via terminal 128. Within each selected group, the segments are activated sequentially via terminals 120–124. LCD 102 in this example is driven in the triplex mode with ⅓ bias ratio. The term "triplex" indicates that the three terminals 120, 122 and 124 are accessed sequentially. The expression "⅓ bias ratio" stands for the ratio between the voltage across a particular one of segments 108–118 to specify the segment's off-state and the voltage across the segment to specify the segment's on-state.

Controller 104 has a plurality of outputs 130, 132, 134, 136 and 138 coupled to terminals 120, 122, 124, 126 and 128, respectively. Outputs 130–138 can assume a logic high state, a logic low state and an inactive state, the latter being commonly referred to as "tri-state". Controller 104 further has at least one output 140 that can assume a logic high state and a logic low state. In the example of the drawing, only one such output 140 is shown in order not to obscure the drawing.

Controller 104 and LCD 102 are coupled via interfacing circuit 106. Interfacing circuit 106 comprises resistors 141, 142, 144, 146, 148 and 150 that are arranged pairwise in series between supply voltage Vcc and GND to form respective voltage dividers coupled to the leads between terminals 120–124 and outputs 130–134. Resistors 141–150 have substantially the same resistance, in this example the resistance being 47K ohm. Output 140 is coupled to terminals 120–124 via resistors 156, 154 and 152, respectively. Resistors 152–156 each have a resistance of substantially 47K ohm in this example. Output 140 further is coupled to a control electrode of a transistor 158. Transistor 158 has a main current path arranged in series with a resistor 160 between a node 162 and GND. A resistor 164 is connected between Vcc and node 162 and a resistor 166 is connected between node 162 and GND. Node 162 is coupled to terminal 126 via a resistor 168 and to terminal 128 via a resistor 170. Resistors 164 and 166 form a voltage divider that is assisted by resistors 160, 170 and 168 under control of the voltages at outputs 136–140. In this example, resistor 160 has a resistance of 680 ohm, resistors 164 and 166 are 1K ohm and 2K ohm, respectively, and resistors 168 and 170 are 47K ohm each.

Figure 2A:
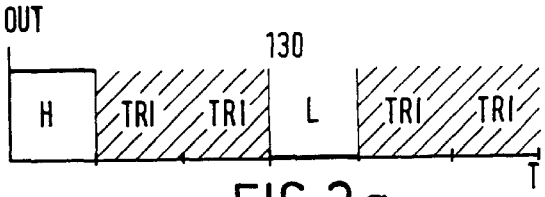
FIGS. 2–7 illustrate the relationship between the signal levels in the apparatus of FIG. 1.
Figure 2B:
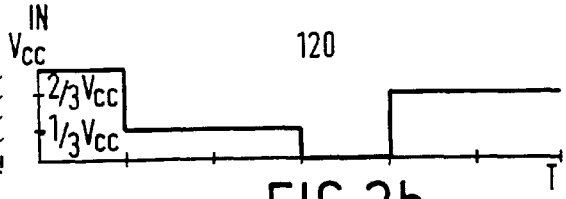

Operation is explained with reference to FIGS. 2–7. As known, segments 108–118 in an LCD are to be driven by signals at terminals 120–128 that periodically reverse their polarity to avoid deterioration of the liquid crystals due to electrochemical decomposition. Part a of FIG. 2 gives, as a function of time, the logic state OUT of the output stage (not shown) of controller 104 that drives output 130, "H" indicating a logic high level of Vcc, "L" indicating a logic low level of GND, and "TRI" indicating the high-impedance state of the output stage. Similarly, parts a of FIGS. 3, 4, 5, 6 and 7 give the logic states of the output stages (not shown) that drive outputs 132, 134, 136, 138 and 140, respectively. Parts b of FIGS. 2–6 give the voltages IN at terminals 120–128, respectively, of LCD as functions of time, the voltages being determined by the logic states, shown in parts a of FIGS. 2–7, of the relevant output stages of controller 104. The time interval shown in the diagrams of FIGS. 2–7 is a complete period, below referred to as T, to illustrate the polarity reversal of the driving voltages occurring at ½T, as known in the art.

Assume that segments 108–112 are sequentially made active, i.e., visible, and that segments 114–118 are kept inactive, i.e., invisible. To this end, output 136, which is connected to terminal 126, is made low for the first half of the period, i.e., from 0 to ½T and high for the second half, i.e., from ½T to T (FIG. 5, part a), while output 138, which is connected to terminal 128, is kept in a high-impedance state from 0 to T (FIG. 6, part a).

The operation is now explained with reference to the time interval from 0 to (⅙)T only. For the other intervals, the operation is in essence the same, mutatis mutandis. The typical resistance values given above ensure creation of the appropriate voltage levels.

Figure 3A:
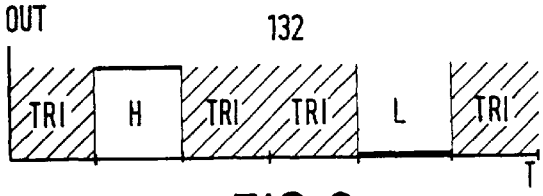
Figure 3B:
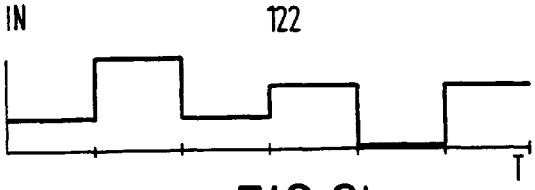
Figure 4A:
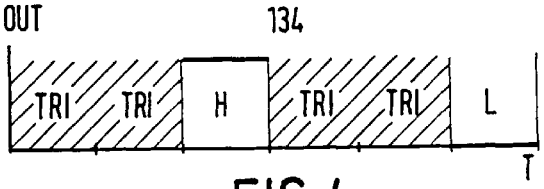
Figure 4B:
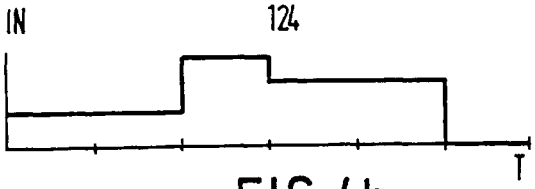
Figure 5A:
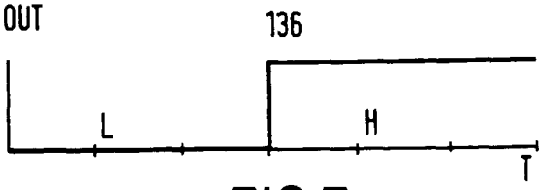
Figure 5B:
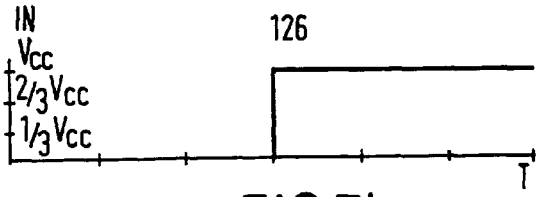
Figure 6A:
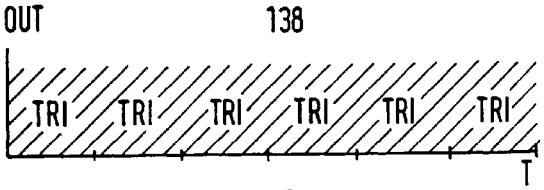
Figure 6B:
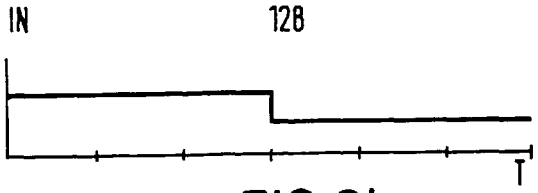
Figure 7:
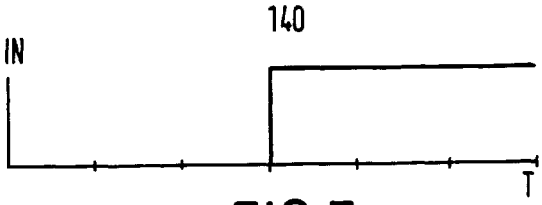

From 0 to (⅙)T, output 130 is driven high (FIG. 2, part a), outputs 132 and 134 are in tri-state (FIGS. 3 and 4, parts a), output 140 is driven low (FIG. 7, part a), output 136 is driven low (FIG. 5, part a) and output 138 is in tri-state (FIG. 6, part a). This results in the following voltages at terminals 120–128. Terminal 120 carries a high voltage Vcc (FIG. 2, part b) and terminal 126 a low voltage GND (FIG. 5, part b). Terminal 122 now is effectively connected to a voltage divider made up of resistors 144 in series with a parallel arrangement of resistors 146 and 154. As resistors 144, 146 and 154 have the same resistance, this results in a voltage of (⅓)Vcc at terminal 122 (FIG. 3, part b). This similarly applies to terminal 124, being connected to a voltage divider made up of resistor 141 in series with a parallel arrangement of resistors 142 and 152 (FIG. 4, part b). Terminal 128 is connected to node 162 through resistor 170. The voltage at node 162 is determined by the voltage divider formed by resistor 164 in series with a parallel arrangement of resistors 166 and 168. Since the resistance value of resistor 168 is substantially larger than that of resistor 166, the voltage at node 162, and therefore at terminal 128, is substantially equal to (⅔)Vcc (FIG. 6, part b).

It is noted that controller 104 may be provided with more than one further output 140 in order to create a division of supply voltage Vcc into five or more levels using additional adaption means. For example, the following levels could be generated: GND, (¼)Vcc, (⅔)Vcc, (¾)Vcc and Vcc with help of two outputs of the type of further output 140 and an extended adaption means 106.

What is claimed is:

1. An apparatus, comprising:

a flat panel display having input means for receiving a control voltage for control of an optical state of the flat panel display;

control means, coupled to the input means, for providing the control voltage, comprising a controller having output means for selectively assuming a logic high state, a logic low state or a high-impedance state, and at least one further output means, and an interface between the input means and the output means, the interface comprising voltage divider means for generating the control voltage, and adaption means coupled between the further output means and the voltage divider means for selectively adapting a voltage division operation of the voltage divider means.

2. The apparatus of claim 1, wherein the adaption means comprises resistive means for being selectively coupled to the voltage divider means.

3. The apparatus of claim 1, wherein the adaption means comprises controllable current source means for being selectively coupled to the voltage divider means.

4. The apparatus of claim 1, wherein the voltage divider means comprises first and second voltage dividers; and the adaption means comprises resistive means for being selectively coupled to the first voltage divider, and controllable current source means for being selectively coupled to the second voltage divider.

5. A control mechanism, for use in an apparatus comprising a flat panel display having input means for receiving a control voltage for control of an optical state of the flat panel display, the control mechanism being coupled to the input means and providing the control voltage, the control mechanism comprising:

a controller, the controller having output means for selectively assuming a logic high state, a logic lcw state or a high-impedance state, and at least one further output means; and an interface between the input means and the output means, the interface comprising voltage divider means for generating the control voltage, and adaption means coupled between the further output means and the voltage divider means for selectively adapting a voltage division operation of the voltage divider means.

6. An interface, for use in an apparatus comprising a flat panel display having input means for receiving a control voltage for control of an optical state of the flat panel display, the apparatus further comprising control means coupled to the input means for providing the control voltage, the control means comprising a controller, the controller having output means for selectively assuming a logic high state, a logic low state or a high-impedance state, and at least one further output means, the interface being disposed between the input means and the output means, the interface comprising: voltage divider means for generating the control voltage, and adaption means coupled between the further output means and the voltage divider means for selectively adapting a voltage division operation of the voltage divider means.

* * * * *